US007567174B2

(12) United States Patent
Woodard et al.

(10) Patent No.: US 7,567,174 B2
(45) Date of Patent: Jul. 28, 2009

(54) COMBINATION ALARM DEVICE WITH ENHANCED WIRELESS NOTIFICATION AND POSITION LOCATION FEATURES

(76) Inventors: Jon A. Woodard, P.O. Box 19646, Seattle, WA (US) 98109; Noel U. Woodard, P.O. Box 19646, Seattle, WA (US) 98109

( * ) Notice: Subject to any disclaimer, the term of this patent is extended or adjusted under 35 U.S.C. 154(b) by 77 days.

(21) Appl. No.: 11/320,011

(22) Filed: Dec. 27, 2005

(65) Prior Publication Data

US 2006/0265195 A1 Nov. 23, 2006

Related U.S. Application Data

(63) Continuation-in-part of application No. 10/660,244, filed on Sep. 11, 2003, now Pat. No. 7,019,646.

(60) Provisional application No. 60/719,821, filed on Sep. 24, 2005, provisional application No. 60/416,970, filed on Oct. 8, 2002, provisional application No. 60/416,971, filed on Oct. 8, 2002.

(51) Int. Cl.
*G08B 1/08* (2006.01)

(52) U.S. Cl. ..... 340/539.26; 340/539.13; 340/628; 340/632; 455/404.1; 455/404.2

(58) Field of Classification Search ..... 340/540, 340/539.26
See application file for complete search history.

(56) References Cited

U.S. PATENT DOCUMENTS

| | | | | |
|---|---|---|---|---|
| 5,019,805 | A | 5/1991 | Curl et al. | 340/628 |
| 5,587,705 | A | 12/1996 | Morris | 340/628 |
| 6,121,885 | A | 9/2000 | Masone | 340/628 |
| 6,426,703 | B1 | 7/2002 | Johnson | 340/628 |
| 6,437,692 | B1 * | 8/2002 | Petite et al. | 340/540 |
| 6,580,367 | B2 * | 6/2003 | Roach | 340/471 |
| 6,717,547 | B2 | 4/2004 | Spilker | 342/464 |
| 6,829,478 | B1 | 12/2004 | Layton et al. | 455/428 |
| 7,034,678 | B2 * | 4/2006 | Burkley et al. | 340/539.13 |
| 7,053,767 | B2 * | 5/2006 | Petite et al. | 340/531 |
| 7,233,781 | B2 * | 6/2007 | Hunter et al. | 455/404.1 |
| 2003/0006898 | A1 * | 1/2003 | Herzberg | 340/540 |

* cited by examiner

*Primary Examiner*—George A Bugg

(57) ABSTRACT

A device and method for determining and automatically transmitting a geographic location of a wireless alarm device during a potential emergency utilizing enhanced wireless communication and position location systems. In one aspect, a wireless alarm device includes a smoke alarm interfaced with a wireless transceiver, configured to operate over a plurality of existing wireless telecommunications and position location networks. The wireless transceiver can be a cellular processor comprising multiple radio frequency bands and air interface standards with an integrated memory for storing emergency identification information. Another aspect includes an integrated assisted global positioning receiver and broadcast television receiver, configured to operate with global positioning systems and broadcast television positioning systems. In one mode of operation, upon sensing the presence of smoke, the wireless transceiver automatically transmits stored emergency identification information signals and a geographic location of the wireless alarm device to a dispatch center.

22 Claims, 4 Drawing Sheets

COMBINATION ALARM DEVICE WITH ENHANCED WIRELESS NOTIFICATION AND POSITION LOCATION FEATURES

CROSS REFERENCE TO RELATED APPLICATIONS

This application is a continuation-in-part of U.S. non-provisional patent application Ser. No. 10/660,244, "Combination Smoke Alarm and Wireless Location Device," by Noel Woodard and Jon Woodard, filed Sep. 11, 2003, now U.S. Pat. No. 7,019,646 B1, dated Mar. 28, 2006; which claims the benefit of U.S. provisional patent applications 60/416,970 and 60/416,971, both of which were filed on Oct. 8, 2002U.S.

This application claims the benefit of U.S. Provisional patent application Ser. No. 60/719,821, "Combination Smoke and Wireless Location Alarm With Enhanced Position Location Features," by Jon Woodard and Noel Woodard, filed Sep. 24, 2005, the disclosure thereof incorporated by reference herein in its entirety.

BACKGROUND

1. Field of the Invention

This disclosure relates generally to smoke and carbon monoxide alarms, wireless communications systems, and wireless positioning systems. More specifically, this disclosure provides a combination device, method for locating a smoke alarm and notifying a dispatch center utilizing wireless telecommunications and position location systems.

2. Description of Related Art

Fire is a widespread and ongoing threat to public safety and homeland security. Fire is known for generating smoke, which often contains many poisonous elements including carbon monoxide. Carbon monoxide is also known as the "silent killer," due to its tasteless, odorless, colorless, and poisonous properties. Carbon monoxide is produced by the incomplete burning of solid, liquid, and gaseous fuels. Many appliances fueled with natural gas, liquefied petroleum, oil, kerosene, coal, charcoal, or wood may produce poisonous carbon monoxide. In addition, running automobiles, recreational vehicles, and other combustion engines produce poisonous carbon monoxide.

Detecting fire and dangerous levels of smoke and carbon monoxide at the earliest stages, alerting building occupants for rapid evacuation, and notifying 911 emergency dispatch operators to summon emergency response personnel are key factors for public safety. However, delay or failure of any one of the key factors dramatically increases the dangers of smoke and fire. Accordingly, reduced physical injury, reduced loss of life, and reduced property damaged are all dependent upon building occupants safely evacuating a building and quickly contacting a emergency dispatch operator to summon further assistance.

Devices for sensing dangerous levels of smoke and carbon monoxide and initiating an alarm are presently available. Single station smoke alarms are available in single sensor units, or combined with carbon monoxide sensors in one alarm.

Although the above-mentioned single station alarms provide many important features, many drawbacks exist. For instance, in larger buildings containing multiple rooms or levels, smoke may be detected in remote or unoccupied areas for unknown periods of time before the occupants are alerted, allowing fire to spread. Furthermore, heavy sleeping, intoxicated, persons on medications, and high-risk (e.g., children, elderly, physically challenged, sensory-impaired) occupants may not hear or otherwise respond to the activated alarm sound before being overcome. Even alarms equipped with a visual alarm or strobe may not awaken this category of occupants due to the aforementioned and other design limitations.

To alleviate the above and other shortcomings, federal, state, and local safety and fire codes may require that newer residences install multiple alarms equipped interconnection means for multiple alarm activation. Alarms are presently available that allow multiple alarms to be interconnected within a building, so when any one of the interconnected alarm senses carbon monoxide or smoke, other interconnected alarms are activated.

Despite solving some of the problems of single station smoke or carbon monoxide alarms, drawbacks exist with interconnected alarms. For example, although interconnected alarms may alert building occupants to smoke in remote or unoccupied areas, if the building is unoccupied or vacant, the danger often goes undetected as the fire spreads to out of control. Only in the event neighbors or other observers haphazardly notice the burning building will emergency response personnel be contacted. Partially alleviating these drawbacks, smoke alarms are presently available that incorporate a landline telephone link.

Other hard-wired or wireless interconnected smoke detectors are part of household or commercial security systems, which are primarily designed for intrusion detection and other security related applications. These systems may employ numerous components, including of a separate wall-mounted control panel, keypad, wireless receiver, and various wireless security sensors. These systems often comprise a landline telephone with auto-dialer connected to a public switched telephone network, which then automatically notifies a central station monitoring facility upon alarm activation, who then retransmits the alert to a 911 operator. Other security systems provide a separate component that contains either primary or back-up wireless transmitters for alerting a commercial central station monitoring facility.

Despite their advantages, shortcomings of integrated security and fire alarm systems containing smoke detectors are numerous. First, such systems are cost prohibitive for fire or carbon monoxide protection, due to the numerous components and sizable installation costs. Because of these costs, non-homeowners or persons with low-income or marginal credit ratings may be unable to afford installation costs and monthly service fees. Second, these systems require skilled technicians to install, test, and maintain. Third, many of these systems may not include detectors with the basic security system package. Furthermore, these systems often employ a separate landline or wireless auto-dialer component, which requires the user to subscribe to separate landline or wireless telephone service, and utilize off-site commercial central station monitoring facility, requiring additional monthly fees. Still another disadvantage is an off-site central station monitoring facility must retransmit any alarm events to a 911 operator.

Other integrated security and fire alarm systems exist that include additional wireless notification, control, and access features using a variety of communication networking mediums, oftentimes a specially designed, proprietary network. These systems often employ various intermediate communications relay or gateway components to communicate with the security or fire alarm system. However, these relays or gateways are physically separated from the detection component, leaving the relay component vulnerable to fire damage before detection. These systems also require that emergency information (e.g., the address of the protected premises) be entered in prior to use in order to determine the location of the alarm event.

A further limitation of all of the above-mentioned smoke detectors, is that they are not specifically designed for installation in building structures undergoing construction, or an effective means for fire monitoring in vacant residences or commercial buildings. In most residential and commercial buildings under construction, there is no means for automated fire monitoring, often no telephone service, and often no registered street address. The workers on the construction site and persons in the immediate vicinity are the primary means for monitoring potential fire dangers. Because such buildings may be vacant during the off-work hours, a fire may burn unnoticed before it rages out of control, causing danger to workers, fire damage to the said building, fire damage to adjacent properties, and increased danger to emergency response personnel.

Although security systems that include smoke detectors have the ability to automatically summon assistance through a intermediate commercial central station monitoring facility, a key drawback of such systems and existing single and multiple station smoke alarms is their lack of effective and timely means for automatic and direct notification to a 911 operator, often referred to as a 911 public safety answering point, of the specific nature and location of the fire emergency.

Wireless telecommunications network systems, often referred to as cellular or PCS networks, along with mobile cellular telephones, are presently available. Aside from being a revolutionary innovation for mobile voice and data communications, many other uses exist, such as determining the geographic location of a mobile cellular telephone. Wireless position location is important for a wide-range of applications including mobile position determination and emergency services.

Most landline telephones in the United States utilizing the public switched telephone network have enhanced 911 service capabilities. Most of these landline enhanced 911 systems have the capability to provide the public safety answering points with a call back number and a physical address of the telephone when calling 911. However, with a growing number of households canceling their landline telephone service and choosing cellular-only telephone or internet telephone service, landline enhanced 911 service becomes unavailable to those households. In most cases, using a cellular telephone or internet telephone to call 911 requires the caller to inform the emergency dispatch operator of the nature and physical location of the emergency.

Due to these issues and a dramatic increase in 911 calls originating from cellular and internet telephones, the U.S. Congress and the Federal Communications Commission ("FCC") enacted regulatory mandates requiring wireless telecommunications carriers to upgrade and modify their cellular and PCS network infrastructures, and make appropriate upgrades to cellular telephones to provide wireless 911 service similar to landline enhanced 911 service. The FCC recently issued an order requiring internet telephone service providers to upgrade their enhanced 911 systems as well.

The efforts of wireless carriers resulted in a number of wireless location system concepts, generally referred to as wireless enhanced 911, to pinpoint or track the location of a cellular telephone during an emergency. The FCC mandates consist of Phase I and Phase II standards that require various levels of position location accuracy.

The Phase I standard generally requires a carrier to provide the closest cell site/sector. Phase II network and handset-based concepts generally pinpoint or track the location of cellular telephones by using either upgraded cellular/PCS network infrastructure, or equipping the cellular telephones with a Global Positioning System (GPS) satellite receiver. It is understood that because neither the network nor handset based wireless position location concepts provide 100% accuracy in all environments, hybrid wireless position location concepts are presently available that combine the advantages of both network and handset-based Phase II position location standard.

However, the aforementioned wireless position location concepts (particularly GPS) have shortcomings when used in urban and indoor environments. To alleviate these shortcomings, other wireless position location concepts utilizing analog and/or digital broadcast television signals are presently available. These improved position location concepts use high power signals, lower frequencies, and wider bandwidth to provide a faster and more accurate position location fix. This wireless position location concept is presently being deployed in several areas for use with 911 emergency services.

It is worth mentioning that the aforementioned wireless position location concepts are primarily designed and utilized for determining the location of voice-only cellular telephones, although many other devices or uses are possible. As previously noted above with other 911 systems, the intended use of wireless enhanced 911 location involves the user seeking emergency assistance to manually enter the "9-1-1" numeric sequence or some variation into the cellular handset keypad, thereby contacting a emergency 911 dispatch operator to report the emergency. Once a connection is made, the user verbally articulates the nature of the emergency to a emergency dispatch operator. Although mobile cellular telephones are an important tool for general safety and emergency reporting, they still require a human user to operate, and are not specially designed for fire safety.

Another issue is that in order to utilize a cellular telephone to call 911 or use wireless enhanced 911 emergency location services, a user is often required to purchase or acquire a mobile cellular telephone, and enter into a subscriber contract with a wireless carrier, which requires an activation fee and monthly service fees. However, persons with low-income or with marginal credit ratings may be unable to afford a cellular subscriber contract. To help alleviate this problem, the federal regulations require that users have access to 911-only, or non-service initialized cellular phones that allow such users to contact a 911 dispatcher. However, these cellular telephones are not designed for automatic notification to 911 operators in fire or carbon monoxide emergencies.

As described above, presently available conventional smoke and combination smoke/carbon monoxide alarms are primarily used for alerting building occupants with an audible or visual alarm, and presently available integrated security and fire alarm systems require an intermediate central station monitoring facility, but provide neither a means for automatic and direct contact to a 911 dispatch operator (i.e., a 911 public safety answering point), nor a means for automatic wireless enhanced 911 position location determination. Conventional smoke alarms also require that evacuating building occupants or bystanders use voice-only landline, cellular, or internet telephones to contact a emergency 911 dispatch operator to report a impending fire or carbon monoxide emergency.

SUMMARY

Therefore, in light of the foregoing shortcomings in the art, it is a object of the present invention to provide a improved combination smoke alarm with an integrated wireless communication and position location circuitry, to automatically detect smoke in the surrounding environment, to automatically initiate a wireless 911 emergency call, to automatically determine the geographic location of a fire emergency, and to automatically notify emergency 911 public safety answering point operators of the location of fire emergencies. Enhanced wireless position location is provided by integrating a wireless transceiver, a broadcast television signal receiver, and/or a GPS receiver. Enhanced wireless notification is provided by a wireless transceiver configured with multiple radio frequency bands and/or multiple air interface standards, and the integration of a wireless networking transceiver.

To achieve the advantages over existing smoke alarms and integrated security systems, one of the aspects is a self-contained smoke alarm that comprises a alarm control circuit and a smoke sensor interfaced with wireless communication and position location circuitry comprising a wireless transceiver. The wireless transceiver may comprise a cellular/PCS transceiver configured with multiple radio frequency bands and/or air interface standards, with a programmed processor configured to initiate an wireless 911 emergency call, and memory containing encoded emergency identification information. Upon sensing a threshold of smoke, the alarm control circuit outputs an alarm signal to the wireless transceiver, transmitting a wireless 911 emergency call. A wireless E911 compliant cellular/PCS infrastructure receives the wireless 911 emergency call and performs signal measurements to determine a position fix, routing the wireless 911 emergency call embedded with combined emergency identification and wireless position location information to a 911 public safety answering point operator. This and other aspects may employ a wireless network transceiver configured for single or multiple radio frequency bands (e.g., IEEE 802.11a/b/g, or 802.16).

In another aspect, the smoke alarm can comprise integrated wireless communication and position location circuitry configured to utilize the combined wireless E911 compliant cellular/PCS infrastructure, digital and/or analog broadcast television infrastructures, and GPS satellites in order to make the fastest and most accurate position determination depending on the availability of the aforementioned infrastructures in a given area. The utilization of the available position location infrastructures overcomes the shortcomings of network-only, broadcast television-only, and conventional GPS position location systems, or where any of the position location infrastructures alone or in combination are unavailable or limited for a precise position fix.

Another aspect can be configured to utilize enhanced cellular/PCS infrastructures upgraded to the FCC Phase II standard. The integrated wireless communication and position location circuitry can comprise a wireless transceiver and an Assisted GPS receiver to work in conjunction with a integrated broadcast television receiver for enhanced position location determination. This aspect overcomes the limitations of existing broadcast television positioning systems that may employ cellular infrastructures that meet the less-accurate Phase I standard or use conventional GPS.

In yet another aspect, the smoke alarm can comprise a combination smoke/carbon monoxide sensor or carbon monoxide sensor configured to detect hazardous levels of carbon monoxide in the environment.

In still another aspect, the smoke alarm can comprise hardwired, wireless, or audio interconnection or network means to communicate an alarm condition to and from other alarm devices, relays, or terminals. Audio interconnection means is preferably used when deploying the devices described herein with conventional smoke or carbon monoxide alarms In addition, the above and other aspects can comprise other features, including: a AC and/or DC power supply, power indicators, multi-band radio frequency signal circuits and signal indicators, audio and visual alarms, alarm delay or disable circuits, and encoding to allow non-service initialized operation.

Although this Summary and the Description below contain many specifics, these should not be construed as limitations on the scope of the invention, but rather an exemplification of embodiments thereof. Accordingly, those skilled in the art may appreciate that this conception, upon which this disclosure is based, may be utilized as a basis for designing other devices, methods, or systems for carrying out the several purposes of the invention.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the description that follows, certain specific details are set forth in order to provide a thorough understanding of various embodiments. However, one skilled in the art will understand that the embodiments may be practiced without these details. In other instances, well known structures associated with smoke and carbon monoxide alarms, wireless networks, and broadcast television networks may not been shown or described in technical detail to avoid unnecessary obscuring descriptions of the embodiments. Unless the context requires otherwise, throughout the specification and claims which follow, the word "comprise" and variations thereof, such as, "comprises" and "comprising" are to be construed in an open, inclusive sense, that is as "including, but not limited to."

Figure 1:
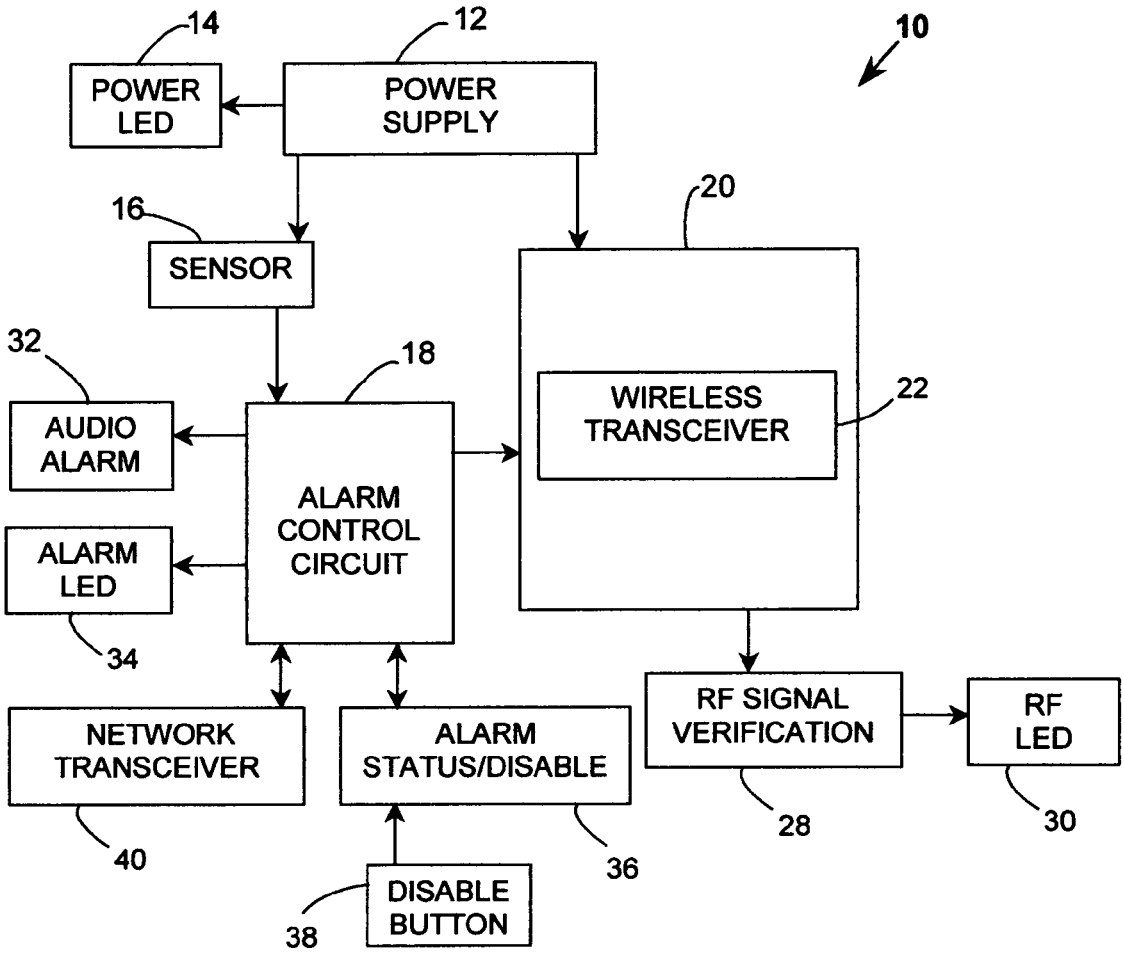
FIG. 1 is a block diagram illustrating a alarm device according to one embodiment.

One embodiment of the combination smoke alarm with enhanced wireless notification and position location features is shown as alarm device 10 in FIG. 1. Alarm device 10 components are preferably confined in a housing (not shown), which can be fixed-mounted to a wall, ceiling, or other surface within a environment or building structure (not shown) configured to be occupied by at least one human being occupant. The environment or building structure may comprise a residential building including a number of living areas, and further comprise a means for generating smoke or carbon monoxide. The human being occupant(s) may have physical or mental disabilities, or have limitations that hinder their ability to otherwise properly react to fire or carbon monoxide emergency events.

The face or surfaces of the housing can comprise a plurality of slots or vents formed to allow the passage of air, smoke, or carbon monoxide into the interior region. The face of the housing can comprise a multitude of apertures or perforations for power status indicators, alarm status indicators, and/or wireless radio frequency ("RF") signal verification indicators. The housing can further comprise one or more buttons for a user to manually verify the operational status of power, sensor, and alarm circuitry of alarm device 10 during stand-by mode, or to execute a time delay function in alarm mode. The housing may further include a internal or external fixed-mounted antenna, or be composed of materials that serve as a means to transmit or receive radio frequency signals. Those skilled in the art will appreciate that many housing shapes or designs, and any configuration of apertures, indicators, displays, or buttons may be used to carry out the objectives of the embodiments herein described.

In FIG. 1, alarm device 10 is a self-contained unit comprising power supply 12, power indicator 14, sensor 16, alarm control circuit 18, wireless communication and position location circuitry 20 (which may comprise a wireless transceiver, a broadcast television signal receiver, and a GPS receiver) multi-band RF signal verification circuit 28, RF signal indicator 30, multi-mode audio alarm 32, alarm indicator 34, alarm status/disable circuit 36, alarm status/disable button 38, and alarm interconnection circuitry 40.

In one aspect, alarm device 10 can detect a amount of smoke in the environment that is hazardous to human being occupants, alerting said occupants by audible or visual alarm signals, and activate wireless communication and position location circuitry to initiate a wireless 911 emergency call, and subsequently transmit signals comprising emergency identification and position location information to a dispatch center, also known as a public safety answering point ("PSAP"). A wireless communication and position location system, comprising at least a cellular or PCS system that is compliant with FCC wireless E911 regulations ("wireless E911 location system"), will also perform a position location sequence to measure the signals transmitted from alarm device 10 to determine the geographic location of alarm device 10. The PSAP subsequently dispatches public safety personnel to the location of alarm device 10.

As illustrated in FIG. 1, power supply 12 comprises AC/DC power management and transformer circuitry, which provides primary and secondary power to alarm device 10. In this embodiment, primary AC power is automatically converted to DC power, and stored in a rechargeable DC battery in the event AC power is interrupted. Power indicator 14, which may comprise an LED or display, is a means for visually monitoring the status of the AC or DC power of alarm device 10. In addition, power supply 12 may comprise a means to provide an audible signal upon low DC power. To obtain its source of AC power, alarm device 10 may comprise an electrical cord, plug, and plug/outlet restraining means to be plugged into an AC outlet of the building structure. Alternatively, alarm device 10 may be hardwired to an AC power source. Other embodiments may comprise primary AC power, primary or secondary DC power, or both.

Next shown in FIG. 1 is sensor 16, which can comprise either a ionization smoke sensor, a photoelectric smoke sensor, or a combination of smoke sensors. Smoke sensor 16 is configured to detect a threshold level of smoke that is hazardous to a human being. In another aspect, smoke alarm 10 can comprise a combination smoke/carbon monoxide sensor or a carbon monoxide sensor to detect a threshold level of carbon monoxide that is hazardous to a human being. The carbon monoxide sensor may comprise a self-purging sensor, solid-state sensor, electrochemical sensor, or a biomimetic sensor, or other type of carbon monoxide sensor. In another aspect, sensor 16 may comprise a single heat sensor or a any combination of heat and smoke or carbon monoxide sensors.

Also illustrated in FIG. 1 is alarm control circuit 18, which can comprise one or more programmed processing units, logic circuits, or microprocessors, and a memory to carry out the detection and alarm functions of alarm device 10. Alarm control circuitry 18 controls the overall operation of alarm device 10, by processing input signals from sensor 16 to determine hazardous conditions in the environment, and subsequently outputs alarm signals to other alarm device 10 alarm components. In a multiple sensor configuration (e.g. dual smoke and carbon monoxide sensors), alarm control circuit 18 can be configured to output an first unique alarm signal indicating a fire emergency, and a second unique alarm signal indicating a carbon monoxide emergency. Alarm control circuit 18 may include programming to automatically or manually execute a self-diagnostic routine that verifies the operational status of power, sensor, and alarm circuitry elements of alarm device 10.

Further illustrated in FIG. 1 and coupled to alarm control circuit 18 is wireless communication and position location circuitry 20, further comprising wireless transceiver 22. Wireless transceiver 22 can comprise a cellular/PCS chipset similar in structure, design, and operation to cellular transceivers or cellular chipsets employed in cellular telephones that are configured to operate in analog or digital cellular/PCS networks. Wireless transceiver 22 is preferably configured to utilize more than one mobile telephone RF bands, one or more mobile telephone air interface standards (e.g. CDMA, GSM, AMPS, TDMA), and/or utilize wireless data transfer protocols (e.g. SMS, CDPD, GPRS) configured to operate in cellular or PCS networks and wireless E911 location systems. Wireless communication and position location circuitry 20 may further comprise programming to automatically or manually execute a diagnostic routine that verifies the operational status of transceiver signals, power, and other critical functions.

Wireless transceiver 22 may further comprise a processor and memory. The processor comprises programmed instructions to automatically initiate a wireless 911 emergency call sequence, which involves transmitting emergency identification information pre-stored in a memory.

The emergency identification information that is pre-stored in wireless transceiver 22's memory can comprise the cellular transceiver's device identification number, including but not limited to a Mobile Identity Number, Electronic Serial Number, International Mobile Equipment Identity, Mobile Station Identifier, or other identity numbers consisting of sequences of characters and/or digits, which are typically used to identify a cellular or PCS device, and typically transmitted over a control channel in a wireless E911 location system. The emergency identification information preferably comprises additional encoding that identifies the type of emergency (e.g. a fire or carbon monoxide emergency), which is also embedded in the wireless 911 emergency call and routed to a PSAP. As stated above, in the event alarm device 10 is configured with smoke and carbon monoxide sensors, the emergency identification information may comprise a first type of encoding indicating a fire emergency, and a second type of encoding indicating a carbon monoxide emergency.

Other information may be combined or embedded with the emergency identification information in the wireless 911 emergency call by the wireless E911 location system, including other position location information, such as the cell site or cell sector, the RF channel, message type, routing information, or longitude and latitude coordinates or other location processing information typically generated during a wireless location sequence by a wireless E911 location system. Once routed to the PSAP, the combined emergency identification and position location information will appear on the PSAP's computer display allowing the operator to dispatch the appropriate public safety personnel to the location of the alarm device 10.

In the embodiments described herein, the user may not be required to obtain a mobile telephone carrier subscriber/service contract to operate alarm device 10. In this aspect, the emergency identification information pre-stored in wireless transceiver 22's memory may further comprise pre-stored information required in non-service initialized 911-only cellular telephones by an FCC order entitled, "Enhanced 911 Emergency Calling Use of Non-Initialized Phones (CC Docket No. 94-102/02-120), such as the proposed consecutive number code "123-456-7890" that serves as the encoded identification number to aid PSAP's in identifying a non-service initialized device calling a PSAP for emergency assistance. Alternatively, the additional pre-stored encoded information may comprise the Emergency Services Interconnection Forum proposed Joint Standard 036 (J-STD-036) entitled, "Enhanced Wireless 911 Phase II, which proposes the use of 911 followed by part of a wireless device's Electronic Serial Number, or International Mobile Station Equipment Identity to create a unique identification number used by a PSAP to identify non-service initialized devices. Current federal law may require that non-service initialized devices be programmed with 911 plus a decimal representation of the seven least significant digits of the Electronic Serial Number, International Mobile Equipment Identity, or any other identifier unique to that device. Alarm device 10 may comprise either the FCC's consecutive number code, J-STD-036, or any variation that is in accordance with current federal law. Configuring alarm device 10 as a non-service initialized device with multiple mobile telephone RF bands and air interface standards may further ensure operation in areas where mobile telephone carriers have infrastructures that operate in multiple mobile telephone RF bands and air interface standards.

Alarm device 10 may be configured to operate in wireless communication and position location network infrastructures which may comprise, in combination, a wireless E911 location system, broadcast television positioning system, and GPS, further described below. Although alarm device 10 may utilize these infrastructures alone or in combination depending on the availability of the infrastructures in a given geographic area, alarm device 10 is preferably configured to utilize wireless communication and position location infrastructures that provide a enhanced or more accurate wireless positioning, further described below.

Alarm device 10 can be configured to operate in a wireless E911 location systems that are upgraded and configured to comply with the mandated FCC Phase I ("E911 Phase I Standard") and/or Phase II ("E911 Phase II Standard") standards governing wireless E911 location systems being deployed by cellular or PCS carriers in any given area or region. As such, the wireless E911 location system may include a cellular or PCS network infrastructure comprised of one or more cell-towers or base stations, mobile switching centers, mobile positioning centers, position determination entities, Global Positioning System (GPS) satellites, and a public switched telephone network. The wireless E911 location system allows PSAP's and public safety personnel to automatically determine the fixed geographic location of a cellular telephone or other device, or in mobile applications, track its movements during emergency calls to 911, based on various levels or accuracy depending on the type of the above-described infrastructure equipment being deployed.

For example, under the E911 Phase I standard, the approximate location of smoke alarm 10 can be determined by the cellular or PCS carrier providing the PSAP with smoke alarm 10's emergency identification and location information that may include cell site or cell sector numbers.

In another example, the E911 FCC Phase II standard allows a more precise location determination using either a network or handset-based location concept. In a Phase II network-based wireless E911 location system, one or more cell towers or base stations and other above-described location infrastructure equipment are employed to process alarm device 10's wireless 911 emergency call signal and perform signal measurements (e.g. time difference of arrival and/or angle of arrival location measurements), then route the resulting location information (e.g., longitude, latitude, uncertainty factor) and any other associated information (e.g., cell site or cell sector numbers, or other routing information) embedded in alarm device 10's wireless 911 emergency call through the carriers' network infrastructure to a PSAP. The FCC Phase II wireless E911 network-based standard requires that the system locate a caller within 100 meters for 67% of the calls, or within 300 meters for 95% of the calls.

In still another example, the E911 Phase II handset-based concept generally integrates a GPS receiver with a cellular transceiver. GPS is a popular satellite-based navigation system that provides coded satellite signals that are processed in a GPS receiver to yield the position and velocity of the receiving unit. This location concept generally requires the line-of-sight signal transmission of a plurality of GPS satellites to determine the longitude and latitude coordinates of the GPS receiver. It is important to note that GPS-only handset-based concepts may exhibit a degraded location determination under circumstances when the GPS signals are obscured, such as indoors, or in building-dense urban areas. In addition, GPS-only has an increased time-to-first-fix. The E911 Phase II standard handset-based concept requires that the system locate a caller within 50 meters for 67% of the calls, or within 150 meters for 95% of the calls.

Other handset-based location concepts provide supplemental location determination for GPS, including Assisted GPS ("A-GPS"), Differential GPS, and Wide Area Augmentation System. Utilizing A-GPS in a wireless E911 location system is known as a "hybrid" network/handset-based location concept that provides advantages over GPS-only and network-based location concepts.

Figure 2:
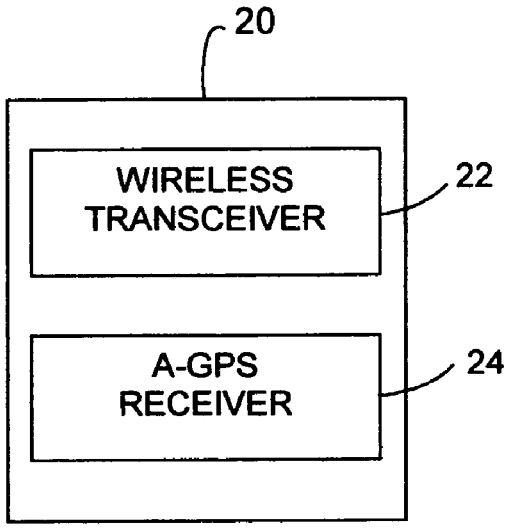
FIG. 2 is a block diagram illustrating the alarm device of FIG. 1 with added components according to one illustrated embodiment.

Now referring to FIG. 2, illustrated therein is another aspect of alarm device 10's wireless communication and position location circuitry 20. As such, alarm device 10's wireless communication and position location circuitry 20 comprises wireless transceiver 22 and A-GPS receiver circuitry 24, similar in structure, design and operation to A-GPS enabled mobile telephones that are configured to operate in hybrid wireless E911 location systems. A-GPS receiver circuitry 24, can comprise a programmed processor and memory, which is configured to automatically initiate a position location function upon receiving a alarm signal. During operation, A-GPS receiver circuitry 24 can be configured to simultaneously collect longitude and latitude measurements from the GPS constellation and the wireless E911 location system. A-GPS receiver circuitry 24 then synchronizes the information with A-GPS configured Position Determination Entity that may be a component in the wireless E911 location system infrastructure, which processes the position location calculations. The resulting enhanced position location information is subsequently combined with the emergency identification information and embedded and transmitted in the wireless 911 emergency call and routed to a PSAP.

Alarm device 10 may also comprise a broadcast television receiver that operates in a broadcast television position location system, and configured to receive digital and/or analog television signals from one or more television transmitters. The television standards preferably comprise receiving American Television Standards Committee ("ATSC") Digital Television ("DTV") signals, and/or National Television System Committee ("NTSC") Analog Television ("TV") signals. Other aspects may comprise receiving European Telecommunications Standards Institute ("ETSI") Digital Video Broadcasting Television ("DVB-T") signals, or Japanese Integrated Services Digital Broadcasting Terrestrial ("ISDB-T") signals.

Broadcast television position location systems use high-power signals and lower frequencies that work well indoors or in dense urban settings. A broadcast television position location system may comprise components that transmit, monitor, track, process, and synchronize DTV or TV signals to acquire and determine the longitude and latitude of alarm device 10. Under ideal conditions and in areas that have sufficient broadcast television position location system infrastructure, position location fixes of within a few meters are common.

Figure 3:
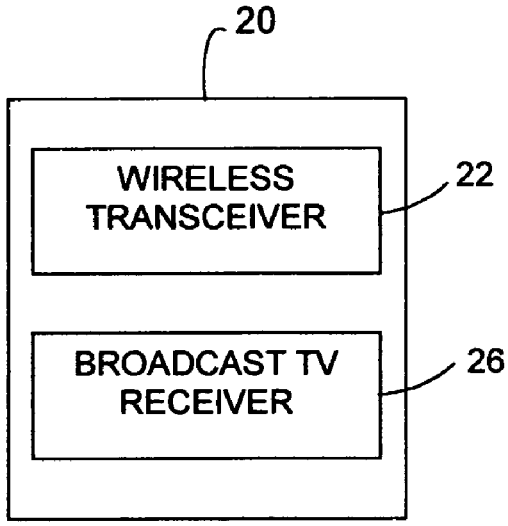
FIG. 3 is a block diagram illustrating the alarm device of FIG. 1 with added components according to one illustrated embodiment.

Now referring to FIG. 3, illustrated therein is still another aspect of alarm device 10's wireless communication and position location circuitry 20. Shown is broadcast television signal receiver circuitry 26, which is connected to wireless transceiver 22. Broadcast television signal receiver circuitry 26 may be configured similar to other broadcast television signal receivers that receive digital or analog television signals from one or more transmitters to determine the position or location of alarm device 10. Broadcast television signal receiver circuitry 26 is configured to automatically initiate a position location function upon receiving an alarm signal, and determine the location of alarm device 10. The resulting enhanced position location information is subsequently combined with the emergency identification information and embedded and transmitted in the wireless 911 emergency call and routed to a PSAP.

Although alarm device 10 may operate in existing broadcast television position location infrastructures, which typically comprises cellular networks and conventional GPS to yield supplementary or enhanced position fixes based on the closest cell site or sector (in a wireless E911 application, complying with the E911 Phase I standard) or other available positioning or signal timing information, it may also operate in areas where broadcast television position location infrastructures are limited, utilizing cellular networks upgraded to the E911 Phase II standard, and/or A-GPS networks for a more accurate, enhanced position fix. Therefore, in another aspect (not shown), wireless communication and position location circuitry 20 may comprise, in combination, a interconnected wireless transceiver, a A-GPS receiver, and a broadcast television receiver all configured to perform wireless position location measurements with increased accuracy.

Now referring back to FIG. 1, further illustrated and connected to wireless communication and position location circuitry 20 is RF signal verification circuit 28 and RF signal indicator 30. RF signal verification circuit 28 and RF signal indicator 30 are configured to allow a user to visually verify that alarm device 10 has sufficient wireless service in order to transmit signals, including a wireless 911 emergency call, and to receive signals from or otherwise communicate with wireless position location systems described herein. RF signal verification circuit 28 may be configured to illuminate RF signal indicator 30 upon receiving predetermined RF signal levels, and to monitor the multiple RF bands of wireless transceiver 22, or other RF signals of alarm device 10. RF signal indicator 30 can comprise one or more LED's or other visual indicator means. In another aspect (not shown), RF signal indicator 30 may comprise a display means, such as a liquid crystal display, which may be configured to display alphanumeric characters to allow a user to visually verify the operational status of RF signals of wireless communication and position location circuitry 20.

Further illustrated and connected to alarm control circuit 18 is high-decibel, multi-mode audio alarm 32, which may comprise a piezo alarm or other high-decibel electronic horn or buzzer. In alarm mode, the audio alarm 32 emits a high-decibel sound upon receiving alarm signals from alarm control circuit 18 indicating a fire or carbon monoxide emergency. In delay mode, audio alarm 32 emits a bursts of intermittent tones to indicate a temporary time delay in the output of alarm signals to wireless communication and position location circuitry 20. The burst of intermittent tones may be interrupted by a user manually pressing alarm status/disable button 38, described below. Further illustrated is alarm indicator 34, which may comprise a LED indicator or display. Alternatively, a high-candela, flashing light source (e.g. white LED's) or other visual means may be employed to alert human occupants to a fire or carbon monoxide emergency.

Next illustrated and connected to alarm control circuit 18 is multipurpose alarm status/disable circuit 36 which is provided to automatically or manually execute a diagnostic routine that verifies the operational status of power, sensor, and alarm circuitry elements of alarm device 10 in stand-by mode, and to suppress nuisance alarm events or inadvertent "non-emergency" 911 emergency calls in alarm mode. Alarm status/disable circuit 36 may be configured with a time delay function, or comprise a switch (not shown) with pre-set time delay settings to temporarily delay the output of alarm signals from alarm control circuit 18 to wireless communication and position location circuitry 20 (or components thereof) for predetermined time periods. Alarm status/disable button 38 allows a user to manually initiate a disable the output of alarm signals to multi-mode audio alarm 32 and alarm indicator 34 for a predetermined time period during alarm mode if the user determines that the alarm is a false alarm or non-emergency situation. If after a predetermined time delay period, sensor 16 no longer senses a threshold level of smoke or carbon monoxide (or alarm interconnection circuit 40 no longer generates activation signals from other remotely located alarm devices, described below), alarm control circuit 18 will reset into stand-by mode and continue monitoring the environment. If after a predetermined time period sensor 16 continues to sense a threshold level of smoke or carbon monoxide (or remote activation signals are still generated), alarm control circuit 18 will output additional alarm signals to activate the audio alarm, alarm indicator, and the wireless communication and position location circuitry. For safety purposes, the time delay function and alarm disable circuit and button may include a default alarm mode beyond a predetermined number of consecutive uses.

Further illustrated in FIG. 1 is alarm interconnection circuit 40, which can comprise wireless network transceiver circuitry and code selector. Wireless network transceiver, connected to alarm control circuit 18, can be configured to transmit and/or receive wireless encoded alarm activation signals between a plurality of alarm devices, relays, hubs, or terminals remotely located within or outside of the building structure. The code selector may include a switch with multiple numeric code settings, which allows a user to preset a code sequence to limit the transmission of the wireless encoded alarm signal to only other devices with the same pre-set numeric code sequence. Wireless network transceiver may comprise single or multiple networking RF bands (e.g., IEEE 802.11a/b/g, or 802.16), and be configured with internet protocol.

In another aspect, alarm device 10 may employ other alarm interconnect circuitry, which may comprise a means to receive audio alarm output signals generated by other alarm horns of remotely located alarm devices or conventional smoke or carbon monoxide alarms.

Figure 4:
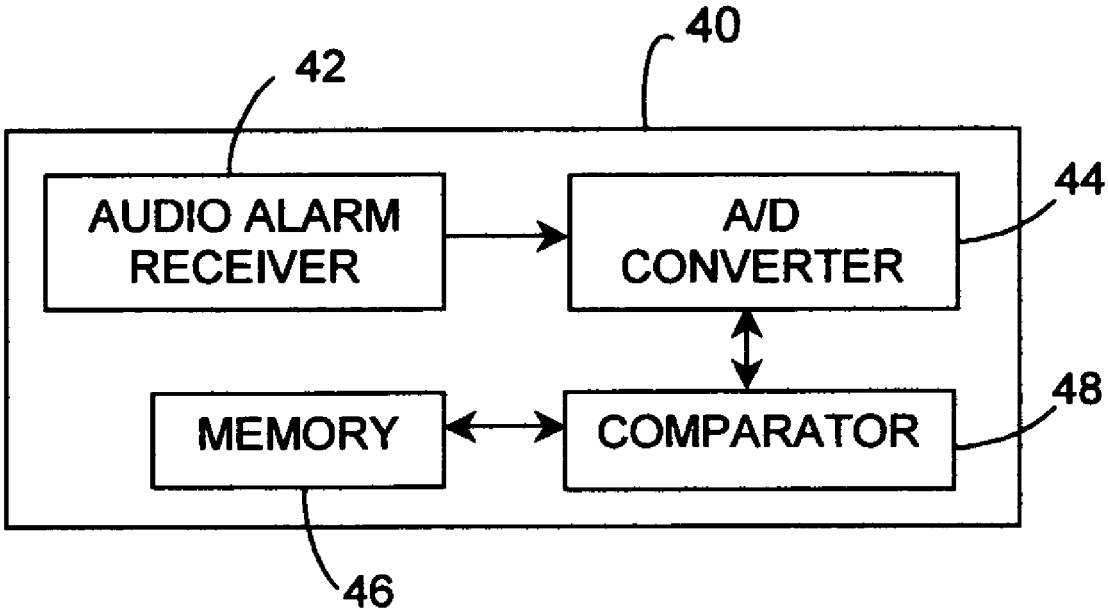
FIG. 4 is a block diagram illustrating the alarm device of FIG. 1 with added components according to one illustrated embodiment.

Referring now to FIG. 4, the alarm interconnect circuitry 40 is shown therein configured with audio alarm signal receiver circuitry, which can comprise a audio alarm signal receiver 42, a memory 44, a analog-to-digital ("A/D") converter 46, and a comparator/processor 48. A digital audio alarm signal reference value comprising distinct audio signal frequencies or tones may be pre-stored in memory 44 during manufacture. In stand-by mode, while sensor 16 monitors the environment for a hazardous condition, audio alarm signal receiver 42 "listens" for these distinct audio signals from other remotely located alarm devices, relays, or terminals. The remotely located alarm units can comprise conventional smoke or carbon monoxide alarms.

Upon receiving a discrete audio alarm signal, the signal is converted from the incoming audio analog signal to a digital signal by the A/D converter 46, and compared to a digital reference value pre-stored in the memory by the comparator/processor 48. If the audio alarm signal matches the pre-stored reference value, alarm control circuit 18 is activated, generating an alarm signal to other alarm device 10 components. Alarm interconnection circuitry 40 may further comprise a manual "on-off" switch to activate or deactivate the audio alarm signal receiver circuitry. Alternatively, the audio alarm signal receiver circuitry may be configured to allow a user to manually store audio alarm signals.

In still another aspect, alarm interconnect circuit 40 can comprise a AC power line carrier signal transmitter/receiver means (not shown) to transmit and receive alarm activation signals between remotely located alarm devices over the AC power wiring of the building structure where protection is provided. Alternatively, alarm interconnection circuit 40 can comprise a means to transmit and receive alarm activation signals to and from other remotely located conventional multiple-station, interconnectable smoke or carbon monoxide alarms equipped with AC power line carrier signal transmitter/receiver means.

Figure 5:
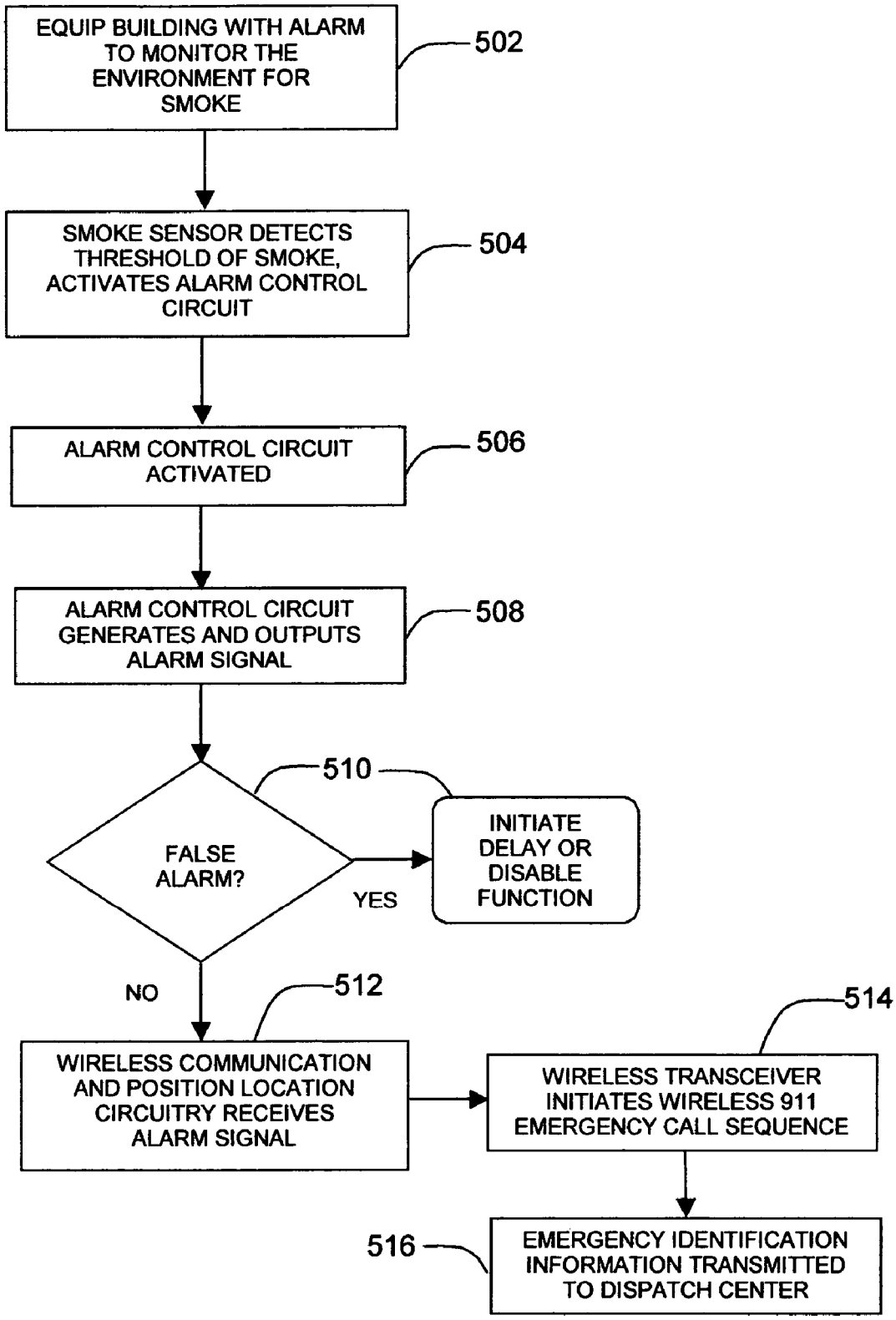
FIG. 5 is a flow chart showing a method of operation for the alarm device according to one illustrated embodiment.

FIG. 5 is a flowchart showing a process for automatically determining the geographic location of alarm device 10, and automatically notifying a PSAP of the location of a fire emergency. The steps depicted in FIG. 5 should not be limited in scope to the specifics of alarm device 10, and may incorporate other embodiments. Additionally, the steps described below in FIG. 5 reference additional or alternate steps comprising further embodiments.

The first step 502 is to equip a environment (e.g. a building structure) with alarm device 10, which monitors the environment for a threshold level of smoke that is hazardous to a human being. The environment can be configured to be occupied by at least one human being, be unoccupied, under construction, or vacant. In an alternate step or embodiment, the environment may comprise the interior of a recreational vehicle, motor home, and/or travel trailer equipped with a portable version of alarm device 10.

In step 504, the sensor detects a hazardous threshold level of smoke, activating the alarm control circuit in step 506. In step 508, the alarm control circuit generates an alarm signal to the audio or visual alarm and the wireless communication and position location circuitry.

In step 510 a user may verify if the alarm event is a false alarm or non-emergency event, and employ means to temporarily delay or disable the alarm signal from activating wireless communication and position location circuitry. If the building structure is occupied, and if the building occupants are alerted by the audio or visual alarm, they may evacuate to safety.

In step 512, the wireless communication and position location circuitry receives the alarm signal, and, in step 514, the wireless transceiver initiates a wireless 911 emergency call sequence. In addition, if an A-GPS receiver is integrated into the wireless communication and position location circuitry, a position location sequence is initiated, and enhanced A-GPS location information is acquired. If a broadcast television signal receiver is integrated into the wireless communication and position location circuitry, a position location sequence is initiated, and enhanced position location information is acquired.

In step 516, the wireless transceiver transmits a wireless 911 emergency call embedded with emergency identification over the above described wireless E911 location system to a dispatch center or PSAP. The emergency identification information further comprises a geographic location of alarm device 10. As described above, if the wireless communication and position location circuitry comprises a A-GPS receiver and/or a broadcast television signal receiver, the enhanced position location information may be combined with the emergency identification information and transmitted to a dispatch center or PSAP.

In an additional step, a PSAP receives the emergency identification and position location information, and further dispatches public safety personnel to the geographic location of alarm device 10. In this step the PSAP may dispatch public safety personnel by various communication means, including but not limited to a public switched telephone network, cellular network, the internet, wireless internet, VHF/UHF radio, enhanced specialized mobile radio, or by SMS, CDPD, GPRS, or MMS messages. In an alternate or additional step, public safety personnel equipped with various communication and computing devices (e.g., personal computers, mobile lap-top computers, two-way radios, pagers, personal digital assistants, mobile cellular telephones), utilizing the above referenced communication means, may directly receive said processed emergency identification and position location information indicating a fire or carbon monoxide emergency at the specific geographic location of alarm device 10.

We claim:

1. A wireless alarm device for detecting a hazardous condition, the device comprising:

a sensor for detecting a hazardous condition in a environment;

a alarm control circuit, in communication with the sensor, the control circuit configured to generate a alarm signal in response to the sensor detecting the hazardous condition;

a disable means for temporarily disabling at least one function of the alarm control circuit;

a wireless transceiver having a integrated memory that includes an wireless enhanced 911 feature with emergency identification information, the transceiver coupled to the alarm control circuit to automatically transmit the emergency identification information to a dispatch center upon receiving the signal from the alarm control circuit;

wherein the wireless transceiver is configured to transmit a plurality of mobile telephone radio frequency signals;

wherein the emergency identification information comprises at least a geographic location of the wireless alarm device.

2. The wireless alarm device of claim 1, wherein the sensor is at least one of a smoke sensor for detecting a hazardous threshold of smoke, a carbon monoxide sensor for detecting a hazardous threshold of carbon monoxide, and a heat sensor for detecting a hazardous threshold of heat.

3. The wireless alarm device of claim 2, wherein the alarm control circuit is configured to output at least one of a first unique alarm signal indicating a fire emergency, and a second type of unique alarm signal indicating a carbon monoxide emergency.

4. The wireless alarm device of claim 3, wherein the emergency identification information is further comprises:

at least one of a first type of encoding indicating a fire emergency, and a second type of encoding indicating a carbon monoxide emergency.

5. The wireless alarm device of claim 4, wherein the emergency identification information further comprises:

a encoded synthesized voice message to indicate at least one of a fire emergency, a carbon monoxide emergency, and a geographic location on the wireless alarm device.

6. The wireless alarm device of claim 1, further comprising:

at least one of a global positioning satellite system receiver and a broadcast television system receiver in communication with the wireless transceiver.

7. The wireless alarm device of claim 1, further comprising:

a radio frequency signal verification means, for verifying a radio frequency signal to at least one of the wireless transceiver, the global positioning satellite system receiver, and the broadcast television system receiver.

8. The wireless alarm device of claim 7, wherein the radio frequency signal verification means comprises a liquid crystal display configured to display at least alpha numeric characters.

9. The wireless alarm device of claim 1, further comprising:

a wireless network transceiver, in communication with the alarm control circuit, configured with at least one wireless networking radio frequency band.

10. The wireless alarm device of claim 9, wherein the wireless network transceiver is configured with a wireless internet protocol.

11. The wireless alarm device of claim 10, wherein the wireless network transceiver is configured with at least one of a IEEE 802.11 wireless networking standard, and a IEEE 802.16 wireless networking standard.

12. The wireless alarm device of claim 11, wherein the wireless network transceiver is configured to communicate with at least one of a remotely located alarm device, a remotely located hub, and a remotely located terminal.

13. The wireless alarm device of claim 1, further comprising:

a housing means encompassing at least the sensor, the alarm control circuit, and the wireless transceiver.

14. The wireless alarm device of claim 1, wherein the alarm control circuit is coupled to a audible alarm that activates when signal is received from the sensor.

15. The wireless alarm device of claim 1, wherein the alarm control circuit is coupled to a visual alarm that activates when signal is received from the sensor.

16. The wireless alarm device of claim 1, wherein the visual alarm comprises at least a white light emitting diode.

17. The wireless alarm device of claim 1, further comprising:

a alarm interconnection circuit comprising at least one of a audio alarm signal receiver, and a alternate current power line signal transceiver.

18. A wireless alarm system comprising:

a wireless transceiver having one or more mobile telephone radio frequency bands, and one or more mobile telephone air interface standards, wherein the wireless transceiver is coupled to a radio frequency verification circuit having a radio frequency indicator;

a memory couple to the wireless transceiver, the memory comprising at least emergency identification information;

at least one of a broadcast television positioning system receiver and a global positioning satellite system receiver, in communication with the wireless transceiver and the radio frequency signal verification circuit;

a alarm control circuit coupled to the wireless transceiver, a audio alarm, a visual alarm, and a time delay circuit;

a audio alarm signal receiver circuit coupled to the alarm control circuit, wherein the receiver circuit is configured to store, receive, convert, and compare distinct audio signal frequencies from remotely located alarm devices and generate a activation signal;

a sensor coupled to the alarm control circuit, configured to detect at least one of a amount of smoke, a amount of carbon monoxide, and a amount of heat;

a power source comprising at least one of a direct current and a alternate current, coupled to at least the sensor and the wireless transceiver.

19. A method for notifying a dispatch center of an emergency condition, the method comprising:

monitoring a environment for at least a threshold of smoke;

sensing at least a threshold level of smoke with a sensor;

activating an alarm with an alarm control circuit, the alarm control circuit in communication with the sensor and configured to be activated upon the sensor sensing at least the threshold level of smoke;

generating an alarm signal from the alarm control circuit;

verifying that the alarm is a emergency event, wherein a user may determine if the alarm is a false alarm and disable the alarm signal from the alarm control circuit;

receiving the signal with a wireless transceiver coupled to the alarm control circuit, the wireless transceiver having an integrated processor and memory;

initiating a wireless 911 emergency call, wherein the processor includes instructions to automatically transmit an amount of emergency identification information stored in the memory;

transmitting the emergency identification information to a dispatch center, wherein the emergency identification information includes at least a geographic location of the wireless transceiver.

20. The method of claim 19, wherein the wireless transceiver is in communication with at least one of a global positioning satellite system receiver and a broadcast television positioning system receiver configured to determine the geographic location of the emergency condition.

21. The method of claim 20, wherein the environment comprises the interior of at least one of a recreational vehicle, a motor home, and a travel trailer.

22. The method of claim 19, wherein the transmitting step further comprises transmitting the emergency identification information and geographic location of the wireless transceiver to one or more remotely located public safety personnel, wherein the public safety personnel are equipped with at least one of a mobile cellular telephone, a mobile computer, and a personal digital assistant.

* * * * *